US005715770A

United States Patent [19]

Heyworth

[11] Patent Number: 5,715,770

[45] Date of Patent: Feb. 10, 1998

[54] TRAILER FOR TRANSPORTING WATERCRAFT

[76] Inventor: Malcolm I. Heyworth, 7235 High Point Ct., Charlotte, N.C. 28278

[21] Appl. No.: 625,177

[22] Filed: Mar. 29, 1996

[51] Int. Cl.[6] ..... B63B 21/58

[52] U.S. Cl. ..... 114/249; 114/258

[58] Field of Search ..... 114/343, 344, 114/258, 270, 242, 248, 249, 250, 230, 220

[56] References Cited

U.S. PATENT DOCUMENTS

| | | | |
|---|---|---|---|
| 3,134,154 | 5/1964 | Smith et al. | 114/230 |
| 3,146,599 | 9/1964 | Young | 114/220 |
| 4,407,214 | 10/1983 | Kawasaki . | |
| 5,353,730 | 10/1994 | Talbot . | |
| 5,354,222 | 10/1994 | Elias | 114/249 |
| 5,357,891 | 10/1994 | Kobayashi et al. . | |
| 5,388,544 | 2/1995 | Kobayashi . | |

FOREIGN PATENT DOCUMENTS

| | | | |
|---|---|---|---|
| 5278678 | 10/1993 | Japan | 114/249 |

*Primary Examiner*—Stephen Avila
*Attorney, Agent, or Firm*—Bell Seltzer Intellectual Property Law Group of Alston & Bird, LLP

[57] ABSTRACT

A trailer for transporting a watercraft using a boat including a frame shaped for receiving one end of a personal watercraft, means for securing the frame to the aft of a boat, and means for securing the personal watercraft to the frame. A housing is connected to the frame to allow for storage of cargo or fuel. Latches are provided on the frame to allow for quick engagement and disengagement of the trailer and the watercraft. A flexible or rigid member is attached to the latches to allow for remote operation.

40 Claims, 5 Drawing Sheets

TRAILER FOR TRANSPORTING WATERCRAFT

BACKGROUND OF THE INVENTION

1. Field of the Invention

The present invention relates to a trailer for transporting a watercraft. More particularly, the present invention relates to a trailer which can be connected to a boat or other watercraft for transporting a personal watercraft on a body of water.

2. Description of the Prior Art

Personal watercraft ("PWC") have become popular over the last ten years. The PWC is a small recreational watercraft which is designed to be operated by a single person. PWC's are generally powered by gasoline engines and are propelled by a jet pump or water jet propulsion.

While PWC's are easy to operate and highly maneuverable, they are small and therefore limited in the number of people and amount of cargo which they can carry. Additionally their fuel storage capacity is relatively small which limits travel distance and operating times.

It is often desirable to transport these PWC's in the tow of a larger boat on large bodies of water, i.e., rivers and lakes, in connection with other water activities such as boating and skiing. One example of a lift is one that attaches to a boat and carries the PWC above the water. This is cumbersome and requires the PWC to be lifted from or lowered into the water and tied down on or untied from the lift. In addition, the lift does not provide any storage space for fuel or other cargo.

Another example of towing is shown in U.S. Pat. No. 4,407,214 to Kawasaki wherein a device is provided for coupling two vessels, e.g., a tugboat and a barge. This device is not suitable for a PWC. U.S. Pat. No. 5,388,544 to Kobayashi shows an unpowered watercraft which can be used in connection with a PWC but does not tow or transport the PWC. Similarly, U.S. Pat. No. 5,353,730 shows a multi-use watercraft containing bays for docking a PWC which uses the PWC for propulsion. This watercraft is not suitable for towing the PWC but is in fact powered by the PWC.

U.S. Pat. No. 5,357,891 to Kobayashi, et al. shows a towed watercraft that is configured to accommodate the water flow from a PWC. The towing devices shown in this patent comprise rigid tow bars which are not readily disconnected from the towing watercraft or the towed watercraft and the PWC is the towing watercraft. Thus, no satisfactory trailer is available for towing or transporting PWC's on water.

It is, therefore, the general object of the present invention to provide a trailer for towing and delivering a PWC on a body of water by another larger watercraft such as a pleasure boat.

Another object of this invention is to provide a trailer for safely and conveniently towing a PWC on a body of water which can be quickly connected to and released from the PWC or the boat.

Yet another object of this invention is to provide a water trailer having a housing which can be used for storing cargo and fuel.

A still further object of the invention is to provide a dock for storing a PWC without using deck space of a larger watercraft or without using dock or pier space.

The foregoing and other objects, advantages and features of this invention, and the manner in which the same are accomplished, will become more readily apparent upon consideration of the following detailed description of the invention taken in conjunction with the accompanying drawings, which illustrate preferred and exemplary embodiments.

SUMMARY OF THE INVENTION

The present invention provides a trailer for transporting a watercraft, such as a PWC, which includes a frame shaped for receiving one end of the PWC, means for securing the frame to the aft area of a second watercraft such as a pleasure boat, means for securing the PWC to the frame, and a housing carried by the frame.

The frame generally comprises a generally U-shaped horizontal member, preferably formed of metal. Bumpers are attached to the horizontal member of the frame for positioning the watercraft for attachment to the frame. The bumpers may consist of one or more rollers or a strip or pad of suitable material, such as rubber, for padding or cushioning the PWC as it rides in the frame or housing. More preferably, one or more rollers generally in the shape of spools or right circular cones having two nappes are used as the bumpers. The trailer is secured to the boat by a latch, preferably at least one spring-loaded pin assembly, which permits easy release of the frame from the boat. A flexible or rigid member may be connected to the latch to allow for remote operation of the latch thereby releasing or connecting the trailer to the boat. A second latch, also preferably a spring-loaded pin assembly, is also provided for easy release or connection of the PWC to the frame of the trailer. Similarly, a flexible or rigid member may be connected to the latch to permit remote operation of this assembly. Locking devices may be provided for security during overnight and long-term docking of the PWC.

A waterproof or watertight housing is connected to the frame in order to provide buoyancy and additional cargo storage. Additionally, the housing may be constructed of material suitable for storing fuel for the watercraft. Gasoline for the PWC may be stored in the trailer. This is particularly advantageous where regulations prohibit carrying more than one type of fuel on a pleasure boat. The housing may be shaped to minimize drag as it is being towed. Furthermore, the housing contains recesses to improve footing while connecting and disconnecting the trailer or the watercraft. Anti-slip material may be placed in the recesses to further improve safety.

DETAILED DESCRIPTION OF THE PREFERRED EMBODIMENTS

Figure 1:
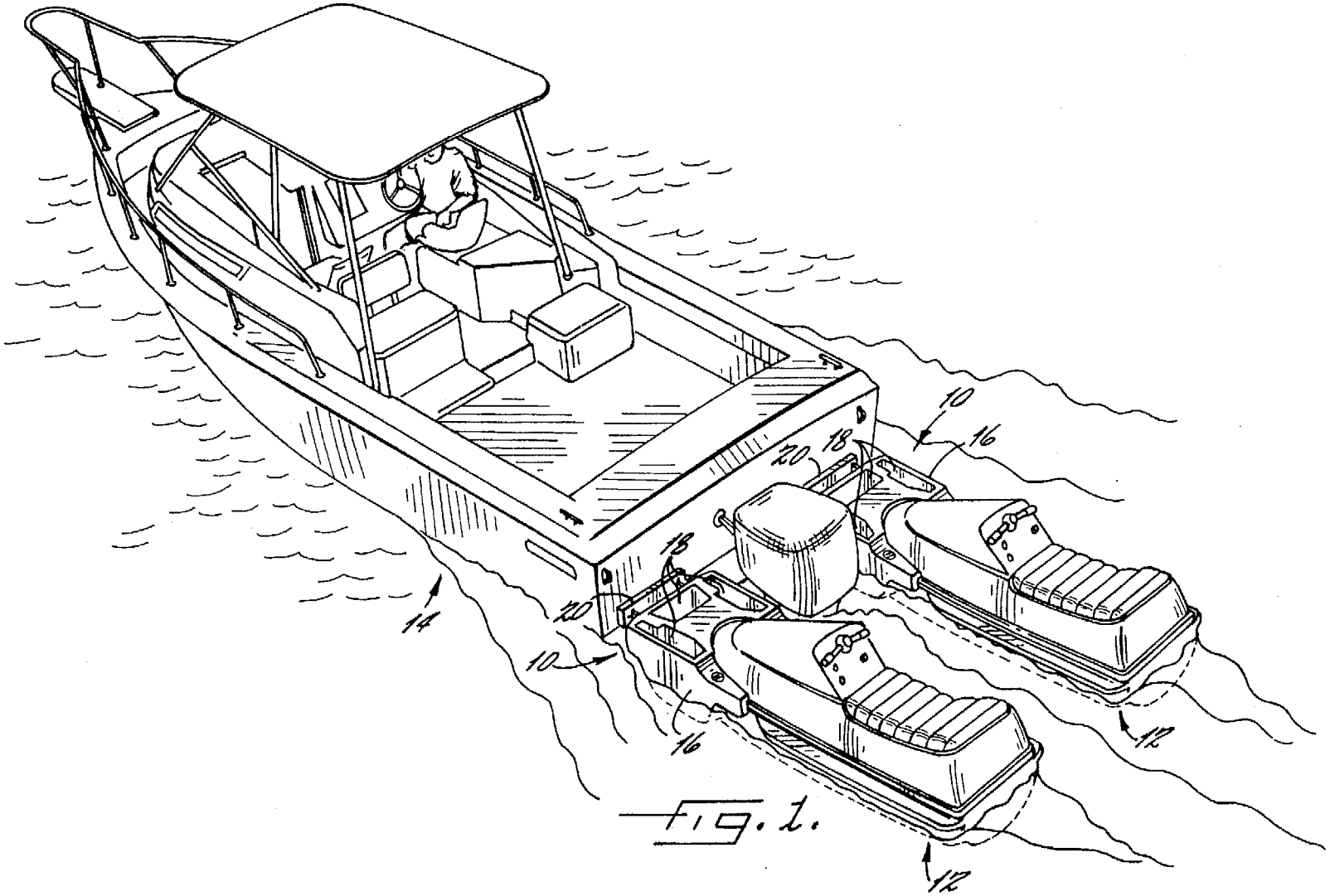
FIG. 1 is a perspective view showing a boat using the watercraft trailer of the present invention towing a PWC.

Referring to FIG. 1, there is shown the trailer of the present invention for transporting a watercraft identified generally by reference 10, in use by an operator of a pleasure boat 14 transporting two PWC's 12. The trailer 10 includes a frame 32, means 22 for securing the frame 32 to the aft of a boat 14, means 36 for securing the watercraft to the frame 32, and a housing 16 carried by the frame 32 as shown most clearly in FIGS. 2, 3 and 4.

Figure 3:
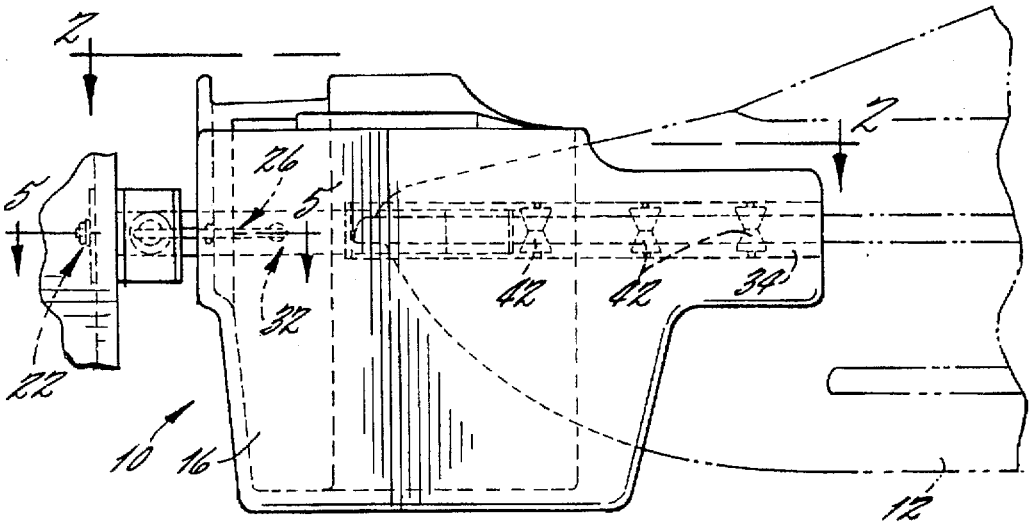
FIG. 3 is a side view of the watercraft trailer of the present invention.
Figure 4:
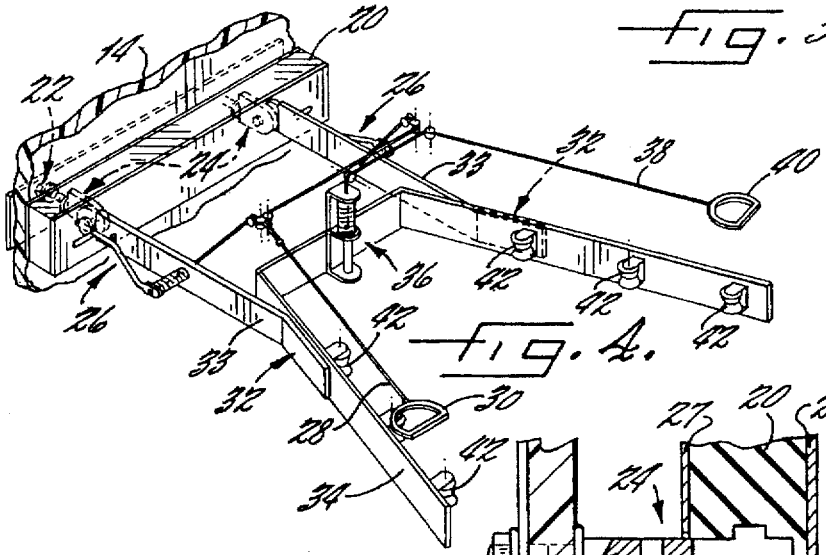
FIG. 4 is a perspective, fragmentary view illustrating the frame of the watercraft trailer of the present invention.

As shown in FIG. 4, the frame 32 generally consists of support arms 33 for supporting a horizontal member 34 shaped for receiving a watercraft. The horizontal member 34 is shaped, preferably U-shaped, for receiving one end of a PWC 12. Bumpers 42 are provided on the interior of the horizontal member 34 of the frame 32 or alternatively on the interior face of the housing above the water line to guide the PWC 12 into the trailer 10 for engagement. The bumpers 42 also protect the PWC 12 during towing. FIG. 3 further illustrates bumpers 42 and the housing 16 connected to the U-shaped member 34 of frame 32 for storage. The bumpers 42 are preferably two or more rollers generally in the shape of a spool, or more particularly, a right circular cone having two nappes which are connected to the U-shaped frame 32. Alternatively, the bumpers 42 may be secured directly to the housing 16. The rollers 42 are made of any suitable material such as rubber to prevent damage to the PWC 12 while towing or while engaging or disengaging the trailer. Alternatively, the bumpers 42 may be rollers in the shape of a wheel or tire. To minimize cost, the bumpers 42 may be a pad or strip of any suitable material such as rubber or plastic attached to the housing 16 or U-shaped member of the frame 34 which will cushion or pad the PWC 12 as it rides in the frame 32 or the housing 16.

The housing 16 of FIG. 3 is made of a waterproof material such as fiberglass, plastic or aluminum and is attached to the frame to provide for storage of cargo or fuel. The housing 16 is mounted within the frame 32 to cause the trailer 10 to float more or less horizontally. Alternatively, the frame 32 and the housing 16 may also be a unitary structure formed of metal, fiberglass or other waterproof material of sufficient strength for holding a watercraft in place while it is being towed. The housing 16 contains recesses 18 on which anti-slip material may be applied to ensure safe footing while connecting and disconnecting PWC 12 or the trailer 10, or while moving from the boat 14 to the PWC 12 and vice versa.

The trailer 10 is connected to the stern or aft area of the boat 14 so as not to interfere with the operation of any inboard or outboard motor and, if necessary, modified for attachment to the aft sides of the boat. The frame 32 or housing 16 construction may also be modified to accommodate the operation of an outboard motor on the boat 14. The trailer 10 is also suitable for connecting to a dock for docking a PWC 12 while not in use. A recessed handle 40 is provided to allow for quick release of the PWC 12 from the trailer 10.

Figure 2:
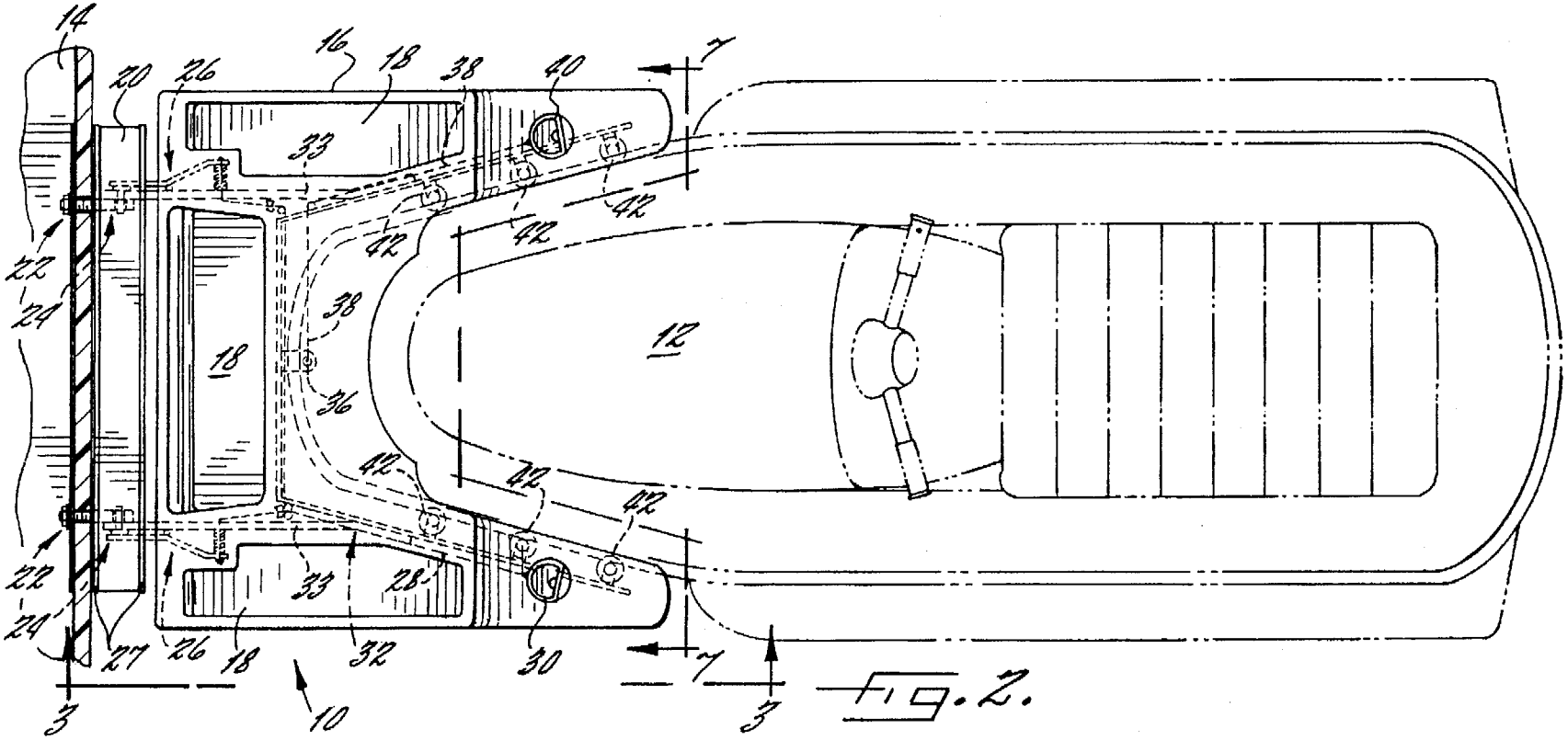
FIG. 2 is a top view illustrating the watercraft trailer of the present invention.
Figure 6:
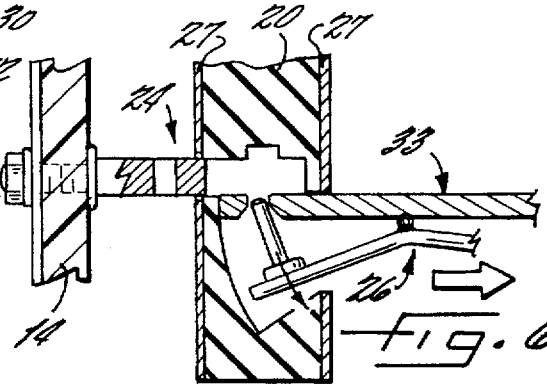
FIG. 6 is a partial cross-section view showing an assembly in the open position for disengaging the water trailer of the present invention from the boat.
Figure 5:
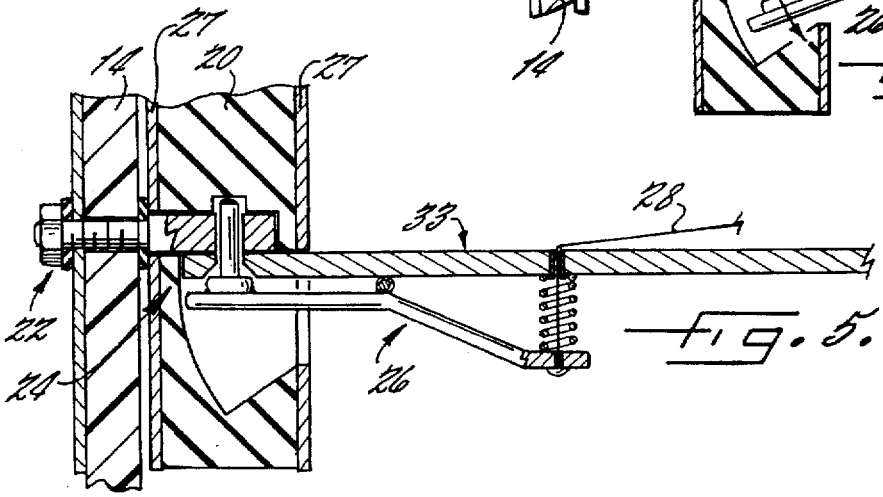
FIG. 5 is a partial cross-section view showing the spring-loaded pin assembly for connecting the frame to the boat.

As seen most clearly in FIG. 2, the trailer 10 is connected to the boat 14 preferably by means of two bolts 22 with connector plates 24 attached thereto, and two latches 26. Alternatively, one bolt or three or more bolts 22 and corresponding latches 26 may be used to attach the trailer 10 to the boat. Similarly, other known methods of mechanical fastening suitable for connecting a trailer for towing may be used such as screwing, welding, or bonding. A vibration absorption member 20 is placed between plates 27 and is notched to allow for pivotal movement of the frame 32. More preferably, the vibration absorption member 20 comprises a solid piece of rubber or other flexible or shock absorbing material attached to the frame 32, as shown in FIGS. 5 and 6, which covers the bolts 22 and cushions or dampens the pivotal movement of the trailer 10 as it is being towed through the water. As shown in FIGS. 2 and 4, a frame connector plate 24 for connecting the frame 32 to the boat is attached to the end of at least one and preferably two bolts 22. A hole in the connector plate 24 receives a latch, pin, or other connector. In the preferred embodiment, a pin of a spring-loaded pin assembly as shown in FIGS. 5 and 6 is used as the latch 26 for quick connect and disconnect of the trailer 10 from the boat 14 and to allow pivotal movement of the trailer during towing. The spring-loaded pin assembly 26 consists of a pin or bolt connected perpendicularly to a lever arm which is pivotally mounted so that the pin engages or disengages the hole in the connector plate 24 on the end of the bolt 22. Of course, it should be understood if a releasable means is desired any suitable arrangement may be used.

In a preferred embodiment, the latch 26 is operated using a flexible member 28, such as a rope, cord, cable, chain, or strap, as shown in FIG. 4. The flexible member 28 is connected to the end of the lever arm under which a spring is disposed to allow for remote operation of the spring-loaded pin assembly 26. Alternatively, a rigid member such as a rod or bar made be substituted for the flexible member 28. A handle 30 is provided on the end of the rigid or flexible member so that, when the handle 30 is pulled, the pins disengage from the holes in the connector plates 24 thereby connecting or disconnecting the trailer to or from the boat. In another preferred embodiment, a winch employing a nylon strap, cable, or rope may be used instead of the flexible or rigid member 28 and handle 30 to operate the latches 26. These latches 26 also allow the trailer 10 to pivot upwardly and downwardly during towing. Additionally, the trailer 10 may be pivoted upwardly for attachment to the stern of the boat when not being used, for example, when the boat is being towed on its trailer.

Figure 9A:
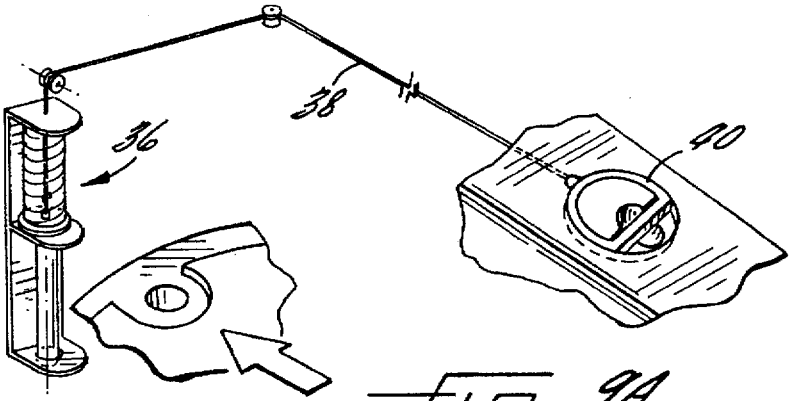
FIG. 9A is a fragmentary view illustrating the latch for maintaining the PWC in the water trailer of the present invention.
Figure 9B:
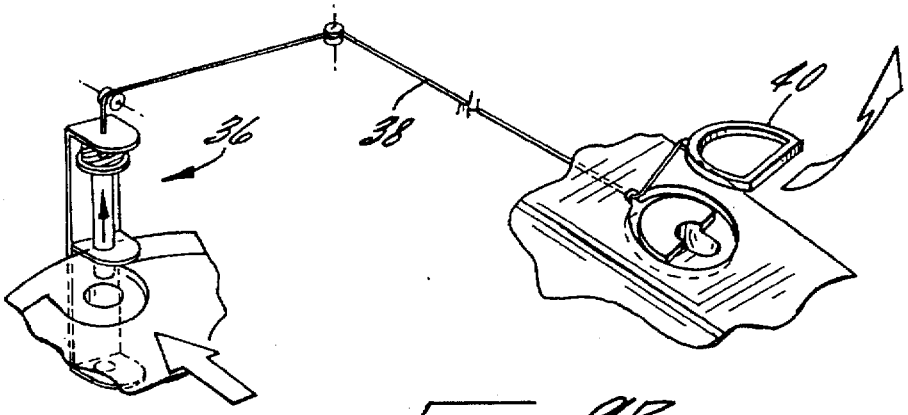
FIG. 9B is a fragmentary view illustrating the latch for maintaining the PWC of the present invention in the open portion.

For connecting and disconnecting the PWC 12 a latch 36, shown in FIG. 4, connected to the midpoint of the U-shaped frame 34 is provided. In the preferred embodiment, the latch 36 generally consists of a spring loaded pin assembly as shown in FIGS. 9A and 9B. Alternatively, the PWC 12 may be connected to the trailer 10 at one or more points or by other means such as tying with ropes, cables, straps, chains, or cords. A flexible member 38, such as a rope, strap, or chain, is connected to the pin assembly to allow for remote operation of the pin to connect and disconnect the PWC 12 and trailer 10 from each other. A rigid member may be used in place of a flexible member 38. A handle 40 is deposed on the end of the rigid or flexible member 38 opposite the latch 36 for easy grasp. As shown in FIGS. 9A and 9B, handle 40 is recessed in the housing 16 for easy access and to help avoid accidental disengagement of the trailer 10 or the PWC 12.

The spring-loaded pin assemblies 26, 36 used to connect the trailer to the boat and the watercraft to the trailer are more clearly shown in FIGS. 4–6. FIG. 4 shows the spring-loaded pin assemblies 26 attached to the frame 32 for engaging and disengaging the trailer 10 and the boat. A flexible member 28 such as a rope, cable, strap, or chain with a handle 30 positioned within reach of a rider on the PWC is routed by small pulleys and is connected to the lever arm of the pin assembly 26 for quick and convenient engagement and disengagement of the trailer. More preferably, a winch with a nylon strap is used as the flexible member and handle. The spring-loaded pin assembly 36 for engaging and disengaging the PWC and the trailer is connected to the U-shaped member 34 of the frame 32 or alternatively to the housing 16 itself. Other suitable means may be employed for securing the PWC 12 to the trailer 10 including a bolt, rope, cord, chain, or cable whether or not it is remotely operated. Locking devices may be provided in connection with the spring assemblies for security during overnight or long-term docking.

FIG. 5 illustrates the preferred spring-loaded pin assembly 26 as it is engaged for attaching the trailer to the boat 14. A lever arm is pivotally attached to the outer sides of the portions of the frame 32 projecting towards the boat so that the pin, which is disposed perpendicularly on the lever, can engage the hole in the end of the bolt 15. A spring is disposed perpendicularly on the end of the lever arm opposite the pin as is a flexible member 28 used to remotely operate the lever arm. FIG. 6 shows the spring loaded pin assembly 26 in the open position to disengage the trailer from the boat.

FIG. 9A shows the spring-loaded pin assembly 36 for connecting and disconnecting the PWC 12 from the trailer 10 comprises a pin having a head disposed on top of the pin against which a spring acts. The pin is vertically disposed in an E-shaped bracket. A spring is placed over the pin and inside the top portion of the bracket so that the pin remains in the downward or closed position unless opened by a flexible or rigid member 38 attached to the top of the pin. A recessed handle 40 is provided on the flexible or rigid member 38 for ease of use as illustrated in FIG. 9B. Alternatively, a spring-loaded pin assembly as is used to connect the boat and trailer may be used. A latch or other mechanical device may be used as a means for connecting the PWC 12 to the trailer 10 whether or not it is remotely operated.

Figure 7:
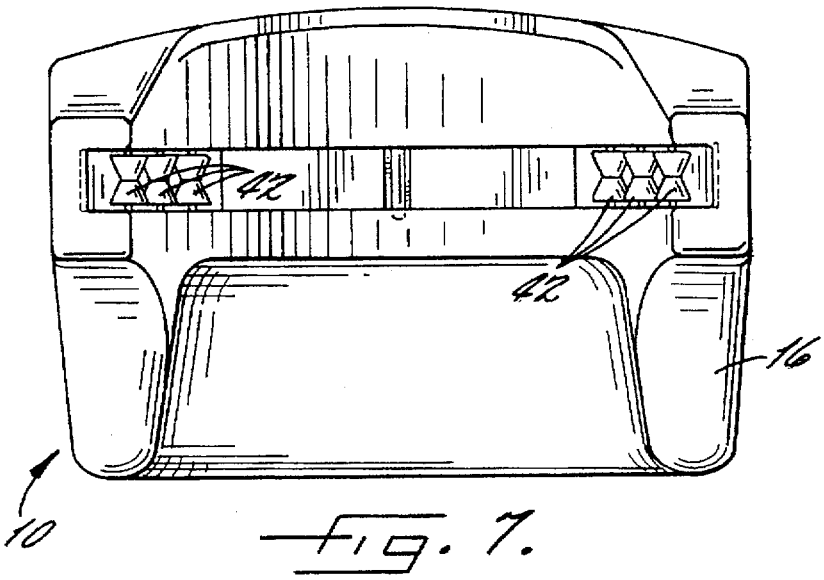
FIG. 7 is an end elevation view of the water trailer of the present invention.
Figure 8:
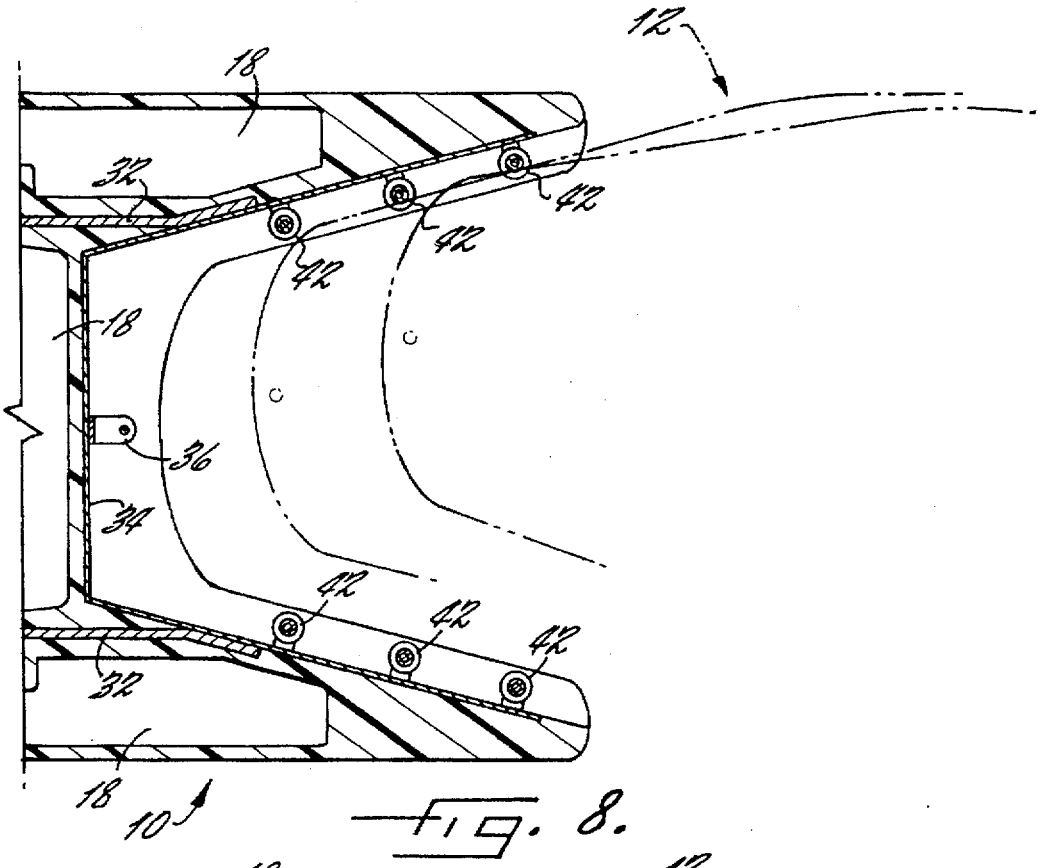
FIG. 8 is a top-sectional view illustrating the docking of the PWC in the water trailer of the present invention.
Figure 9:
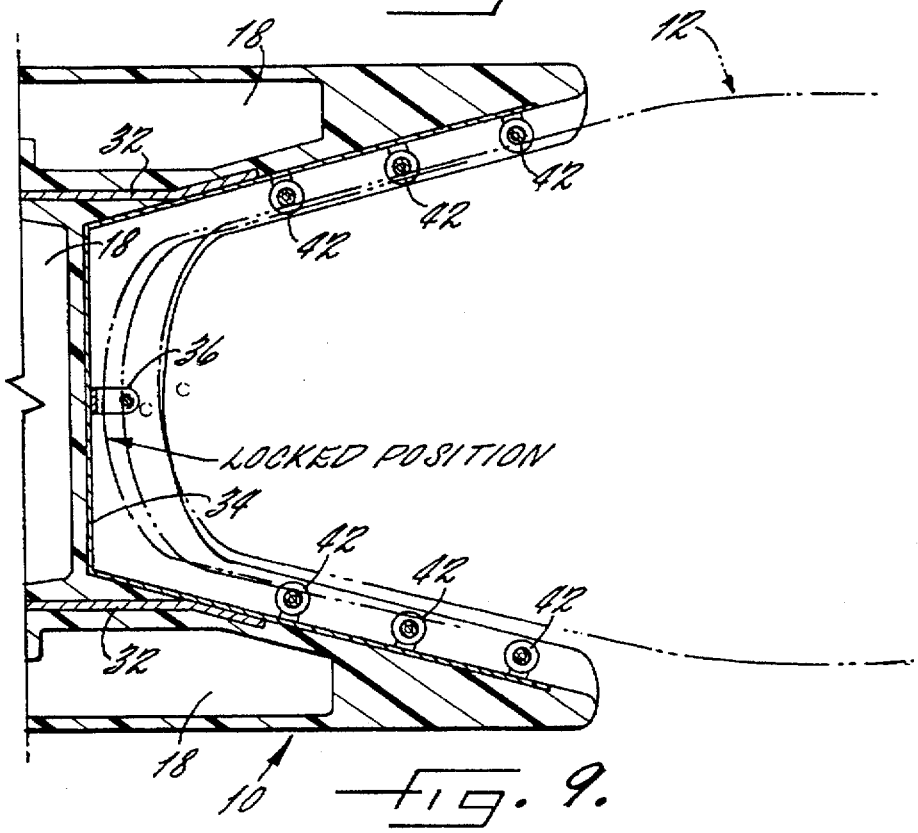
FIG. 9 is a top-sectional view illustrating the water trailer and showing a PWC in phantom.

As shown in FIGS. 8 and 9, the bumpers 42 assist in positioning the PWC 12 for engagement with the trailer. The bumpers 42 are generally spool-shaped rollers as shown in FIG. 7. Rollers of any configuration, strips, or pads also may be used as the bumper and should be made of suitable material for padding or cushioning the PWC while being towed.

While the preferred embodiments of this invention have been illustrated in detail, it should be readily apparent to those skilled in the art that the other embodiments may be conceived and fabricated without departing from the spirit and scope of this invention.

What is claimed is:

1. A trailer for use in transporting a watercraft on a body of water comprising:

a frame having a horizontal member and a pair of arms extending therefrom shaped for receiving one end of a watercraft;

means for securing said frame to the aft of a powered boat said means for securing said frame to said boat comprising at least one first latch which permits easy release of said frame from said boat; and means for securing said watercraft to said frame, said means for securing said watercraft to said frame comprising a second latch which permits easy release of said watercraft from said trailer.

2. The trailer according to claim 1 wherein said frame is a generally U-shaped member.

3. The trailer according to claim 1 wherein a plurality of bumpers are attached to said arms for positioning said watercraft for attachment to said frame.

4. The trailer according to claim 3 wherein said bumpers are generally spool-shaped rollers.

5. The trailer according to claim 1 wherein a first flexible member is connected to said first latch to allow remote operation of said latch.

6. The trailer according to claim 1 wherein a first rigid member is connected to said first latch to allow remote operation of said latch.

7. The trailer according to claim 1 wherein a second flexible member is connected to said second latch to permit remote operation of said second latch to disconnect said watercraft from said frame.

8. The trailer according to claim 1 wherein a second rigid member is connected to said second latch to allow remote operation of said second latch to disconnect said watercraft from said frame.

9. The trailer according to claim 1 further comprising a housing attached to said frame.

10. A trailer for use in transporting a watercraft on a body of water comprising: a generally U-shaped frame having a horizontal member and a pair of arms extending from said horizontal member for receiving one end of a watercraft;

a plurality of bumpers attached to said frame for positioning said watercraft for attachment to said frame;

means for securing said frame to a boat, said means for securing said frame to said boat comprising at least one first latch which permits easy release of said frame from said boat; and means for securing said watercraft to said frame, said means for securing said watercraft to said frame comprises a second latch which permits easy release of said watercraft from said frame.

11. The trailer according to claim 10 wherein a first flexible member is connected to said first latch to allow remote operation of said latch.

12. The trailer according to claim 10 wherein a first rigid member is connected to said first latch to allow for remote operation of said latch.

13. The trailer according to claim 10 wherein a second flexible member is connected to said second latch to allow for remote operation of said second latch.

14. The trailer according to claim 10 wherein a second rigid member is connected to said second latch to allow for remote operation of said second latch.

15. The trailer according to claim 10 wherein said bumper is at least one generally spool-shaped roller.

16. The trailer according to claim 10 further comprising a housing attached to said frame.

17. A trailer for transporting a watercraft on a body of water comprising:

a frame having a horizontal member and a pair of arms extending therefrom shaped for receiving one end of a watercraft;

a housing attached to said frame to provide buoyancy to said trailer;

a bumper attached to said frame for positioning said watercraft for attachment to said frame;

means for securing said frame to a boat; and means for securing said watercraft to said frame.

18. The trailer according to claim 17 wherein said means for securing said frame to said boat comprises at least one first latch which permits easy release of said frame from said boat.

19. The trailer according to claim 18 wherein a first flexible member is connected to said first latch to allow for remote operation of said latch.

20. The trailer according to claim 18 wherein a first rigid member is connected to said first latch to allow for remote operation of said latch.

21. The trailer according to claim 17 wherein said means for securing said watercraft to said frame comprises a second latch which permits easy release of said watercraft from said frame.

22. The trailer according to claim 21 wherein a second flexible member is connected to said second latch to allow for remote operation of said second latch.

23. The trailer according to claim 21 wherein a second rigid member is connected to said second latch to allow for remote operation of said second latch.

24. The trailer according to claim 17 wherein said bumper is at least one generally spool-shaped roller.

25. The trailer according to claim 17 wherein said housing is made of waterproof material.

26. The trailer according to claim 25 wherein said housing contains recesses.

27. The trailer according to claim 26 wherein said recesses in said housing contain a anti-slip material.

28. The trailer according to claim 25 wherein said housing is substantially watertight and suitable for storage.

29. The trailer according to claim 28 wherein said housing is suitable for storing fuel.

30. A trailer for transporting a watercraft on a body of water comprising:

a housing attached to and at least partially surrounding a frame, said frame shaped for receiving one end of a watercraft, said housing causing said trailer to float;

means for securing said housing to the aft of a boat, said means for securing said housing to said boat comprises a first latch which permits easy release of said housing from said boat; and means for securing said watercraft to said frame.

31. The trailer according to claim 30 wherein a first flexible member is connected to said first latch assembly to allow for remote operation of said first latch.

32. The trailer according to claim 30 wherein a first rigid member is connected to said first latch to allow for remote operation of said first latch.

33. The trailer according to claim 30 wherein said means for securing said watercraft to said housing comprises a second latch which permits easy release of said watercraft from said housing.

34. The trailer according to claim 33 wherein a second flexible member is connected to said second latch to allow for remote operation of said second latch.

35. The trailer according to claim 33 wherein a second rigid member is connected to said second latch to allow for remote operation of said second latch.

36. The trailer according to claim 30 wherein said housing is made of a buoyant and waterproof material.

37. The trailer according to claim 30 wherein said housing contains recesses.

38. The trailer according to claim 37 wherein said recesses in said housing contain a anti-slip material.

39. The trailer according to claim 30 wherein said housing is substantially watertight and suitable for storage.

40. The trailer according to claim 30 wherein said housing is suitable for storing fuel.

* * * * *